US008750759B2

(12) United States Patent
Shibuya

(10) Patent No.: US 8,750,759 B2
(45) Date of Patent: Jun. 10, 2014

(54) IMAGE FORMING APPARATUS

(71) Applicant: Kyocera Document Solutions Inc., Osaka (JP)

(72) Inventor: Teppei Shibuya, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 0 days.

(21) Appl. No.: 13/953,169

(22) Filed: Jul. 29, 2013

(65) Prior Publication Data

US 2014/0029964 A1 Jan. 30, 2014

(30) Foreign Application Priority Data

Jul. 27, 2012 (JP) ..... 2012-166761

(51) Int. Cl.
*G03G 21/00* (2006.01)

(52) U.S. Cl.
USPC ..... 399/128; 399/66

(58) Field of Classification Search
CPC . G03G 15/0131; G03G 15/169; G03G 21/06; G03G 21/08
USPC ..... 399/66, 128
See application file for complete search history.

(56) References Cited

U.S. PATENT DOCUMENTS

| | | | | |
|---|---|---|---|---|
| 5,983,041 | A * | 11/1999 | Otaki et al. | 399/45 |
| 2004/0126148 | A1* | 7/2004 | Iwai et al. | 399/296 |
| 2008/0159783 | A1* | 7/2008 | Jung et al. | 399/128 |
| 2010/0239280 | A1* | 9/2010 | Inoue | 399/44 |
| 2011/0249987 | A1* | 10/2011 | Ishino et al. | 399/128 |
| 2013/0136499 | A1* | 5/2013 | Kamiyama | 399/128 |
| 2013/0195488 | A1* | 8/2013 | Hatano | 399/128 |
| 2013/0195507 | A1* | 8/2013 | Morishita | 399/128 |

FOREIGN PATENT DOCUMENTS

| | | |
|---|---|---|
| JP | 06-095476 | 4/1994 |
| JP | 2003-263036 | 9/2003 |

* cited by examiner

*Primary Examiner* — Ryan Walsh
(74) *Attorney, Agent, or Firm* — K&L Gates LLP

(57) ABSTRACT

An image forming apparatus includes a plurality of image forming units, an endless transfer belt, and a plurality of transfer rollers. Each image forming unit includes a photosensitive drum, a charging unit, a developing unit, and a static remover. The static remover emits charge-removing light to the circumferential surface of the photosensitive drum included in the image forming unit before a transfer to the circumferential surface is performed. The amount of pre-transfer charge-removing light emitted to the circumferential surface of a photosensitive drum by one static remover included in the plurality of image forming units is set to a value less than the amount of pre-transfer charge-removing light emitted to the circumferential surface of another photosensitive drum by another static remover located upstream of the one static remover in the movement direction of an intermediate transfer belt.

8 Claims, 9 Drawing Sheets

IMAGE FORMING APPARATUS

INCORPORATION BY REFERENCE

This application is based upon, and claims the benefit of priority from, corresponding Japanese Patent Application No. 2012-166761, filed on Jul. 27, 2012, the entire contents of which are incorporated herein by reference.

BACKGROUND

The present disclosure relates to an image forming apparatus that forms an image on a sheet, and more particularly to an image forming apparatus having static removers, each of which removes charges from the circumferential surface of a photosensitive drum before a transfer is carried out.

In a known technology, a toner image formed on a photosensitive drum is transferred to a transfer belt as a primary transfer. Thereafter the toner image is transferred from the transfer belt to a sheet as a secondary transfer.

A transfer roller is brought into contact with the photosensitive drum with a transfer belt interposed therebetween. A transfer voltage is applied to the transfer roller under constant current control so that a stable transfer electric field is formed when the primary transfer is carried out.

When the above constant current control is carried out, in a transfer nip part, the difference in electric potential between the non-image part on the photosensitive drum and the transfer roller is likely to be greater than the difference in electric potential between the image part on the photosensitive drum and the transfer roller. When the difference in electric potential between the non-image part on the photosensitive drum and the transfer roller is greater than the difference in electric potential between the image part on the photosensitive drum and the transfer roller, a large amount of transfer current flows into the non-image part on the photosensitive drum. When the transfer current is increased under constant current control to secure transfer performance, current that flows into the non-image part is also increased. This has led to a problem that there is a change in the charging property between the image part and non-image part on the photosensitive drum and a so-called transfer memory occurs.

Technologies described below are known to resolve this transfer memory.

In a technology, charges are removed from the surface of the photosensitive drum before the primary transfer to reduce the difference in electric potential between the image part and the non-image part. When charges are removed from the surface of the photosensitive drum before the primary transfer, however, toner on the image part is likely to scatter to the non-image part.

In another technology, to suppress the above scatter of toner, the electric potential at the non-image part around the image part is made greater than at the image part. Although, with this technology, the difference in potential between the image part and non-image part on the photosensitive drum is comparatively low, a current flow into the non-image part cannot be prevented, so it is difficult to resolve a transfer memory.

In another known technology, charges are removed only from the photosensitive drum in black located at the downstream end in a tandem-type image forming apparatus without dropping the electric potential at the non-image part to prevent the toner in black from scattering. However, this technology causes a transfer memory due to a difference between a transfer current flowing into the image part on the photosensitive drum and a transfer current flowing into the non-image part thereon. Another problem with the tandem-type image forming apparatus is that when toners in a plurality of colors are transferred while being overlapped, toners are likely to noticeably scatter.

SUMMARY

An image forming apparatus in an embodiment of the present disclosure includes a plurality of image forming units, each of which has a photosensitive drum, a charging unit, a developing unit, and a static remover, and also has an endless transfer belt and a plurality of transfer rollers. The photosensitive drum has a rotational axis, and rotated in a prescribed rotational direction so that an electrostatic latent image is formed on the circumferential surface of the photosensitive drum and supports a toner image that matches the electrostatic latent image. The charging unit charges the circumferential surface. The developing unit supplies toner to the circumferential surface. The static remover emits charge-removing light to a portion of the circumferential surface, the portion being downstream of the developing unit in the rotational direction. The endless transfer belt is brought into contact with a plurality of photosensitive drums of the plurality of image forming units and is rotated so that the surface of the endless transfer belt moves in a prescribed movement direction with respect to the plurality of photosensitive drums and toner images are sequentially transferred to the surface. The plurality of transfer rollers, each of which has a roller axis, are located so as to face the plurality of photosensitive drums with the transfer belt interposed therebetween, and transfer the toner images to the transfer belt. The static remover emits pre-transfer charge-removing light to a circumferential surface portion upstream of a position opposite to the position of the transfer roller in the rotational direction; the amount of pre-transfer charge-removing light emitted to the circumferential surface by one static remover included in the plurality of image forming units is less than the amount of pre-transfer charge-removing light emitted to another circumferential surface by another static remover located upstream of the one static remover in the movement direction.

Additional features and advantages are described herein, and will be apparent from the following Detailed Description and the figures.

DETAILED DESCRIPTION

Figure 1:
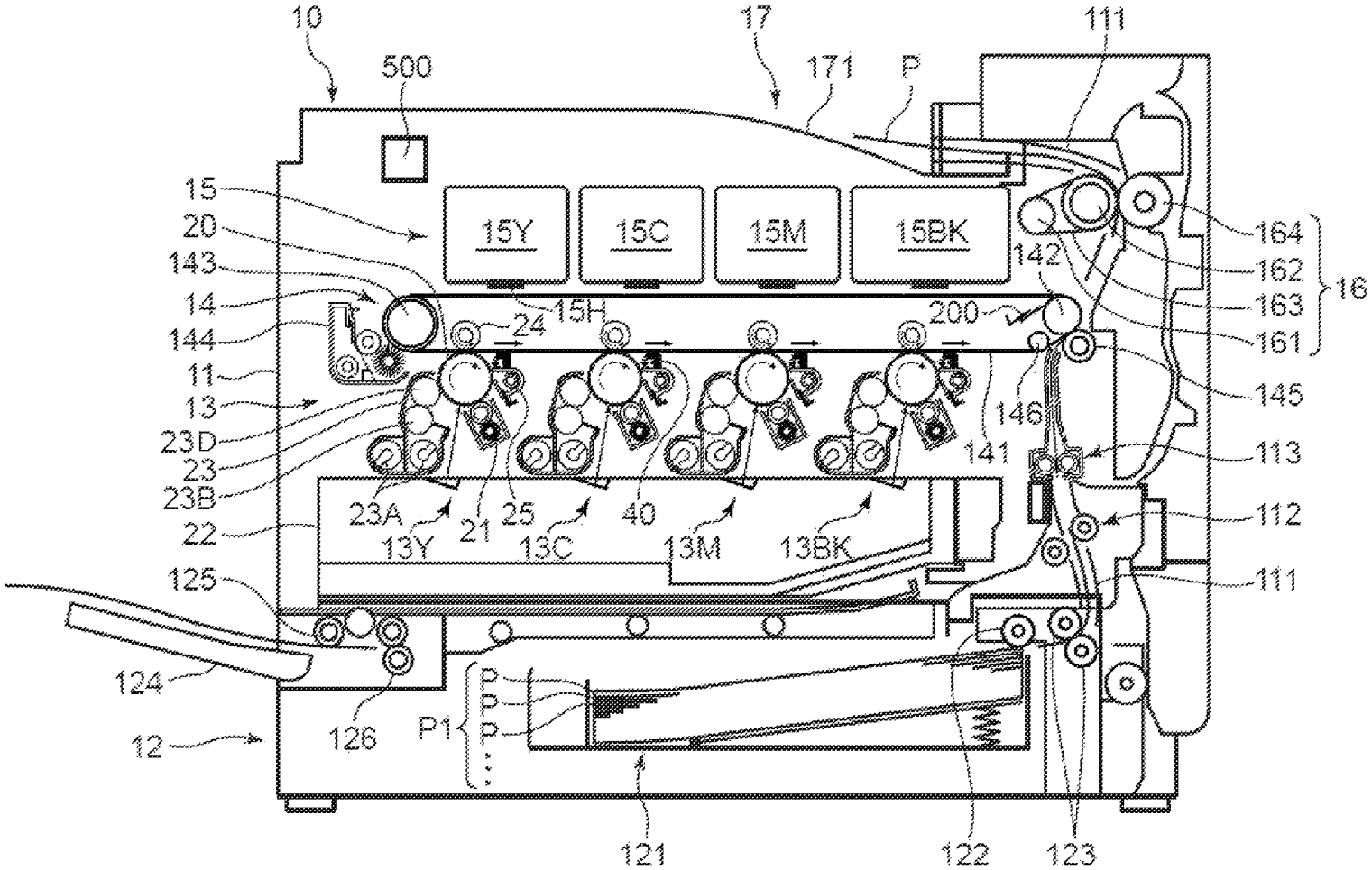
FIG. 1 is a cross-sectional view illustrating the internal structure of an image forming apparatus in an embodiment of the present disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

An embodiment of the present disclosure will be described in detail with reference to the drawings. In this embodiment, a tandem-type color printer will be described as an example of an image forming apparatus. The image forming apparatus may be, for example, a copier, a facsimile machine, or a multi-function peripheral in which these machines are combined.

Figure 2:
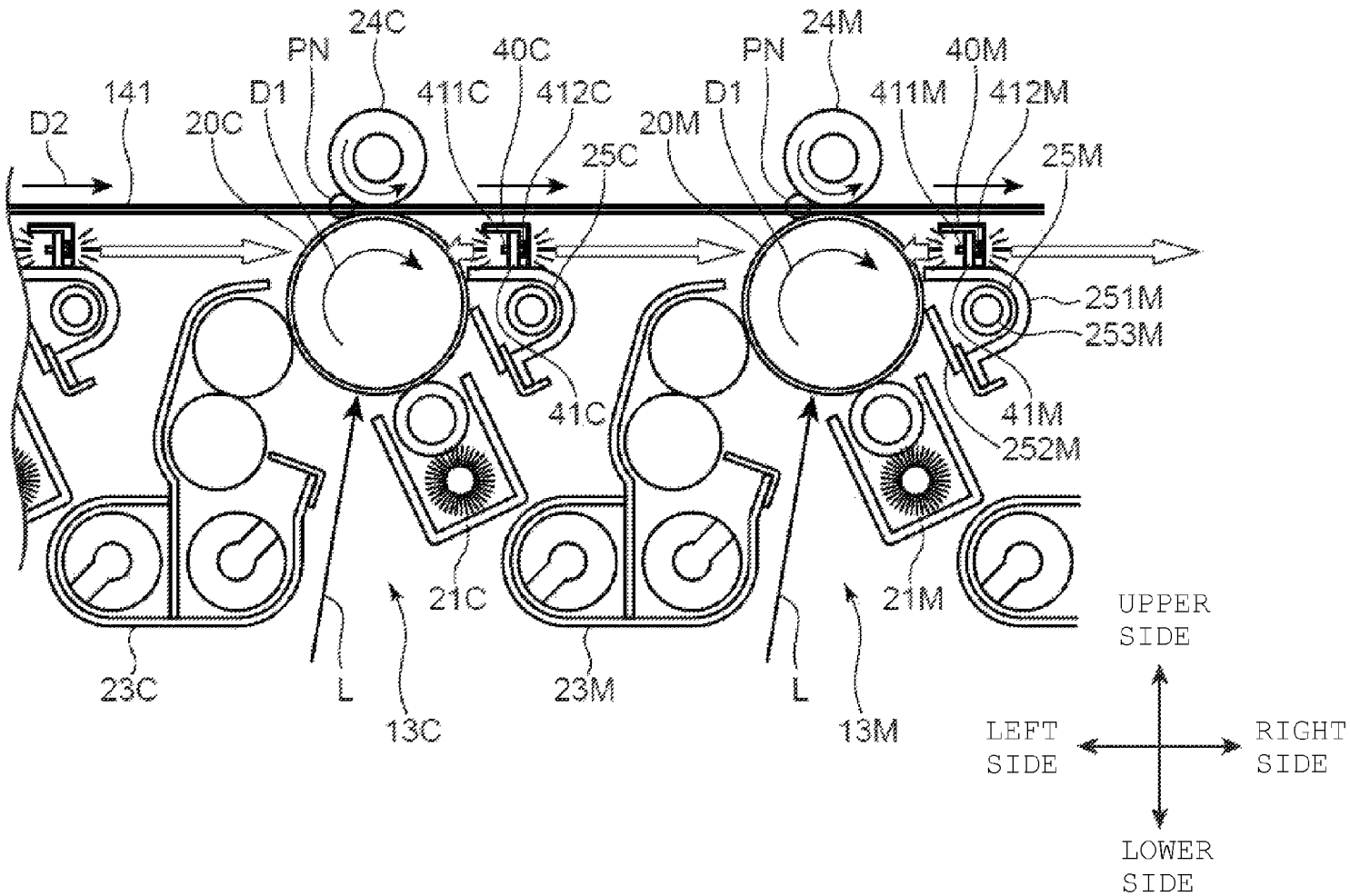
FIG. 2 is an enlarged cross-sectional view illustrating the periphery of photosensitive drums included in the image forming apparatus in an embodiment of the present disclosure.

FIG. 1 is a cross-sectional view illustrating the internal structure of an image forming apparatus 10. FIG. 2 is an enlarged cross-sectional view illustrating the periphery of photosensitive drums 20 included in the image forming apparatus 10. In FIG. 2, two adjacent image forming units 13C and 13M are enlarged; the letters C and M at the ends of the reference characters of these image forming units indicate colors. In descriptions below in which structures common to image forming units in different colors are discussed, the color-indicating letters at the ends of their reference characters will be omitted. The image forming apparatus 10 has a main body 11 with a box-like case. The main body 11 includes a paper feeder 12 that feeds sheets P, an image forming section 13 (sometimes referred to below as the image forming section or image forming sections) that forms a toner image to be transferred to a sheet P supplied from the paper feeder 12, an intermediate transfer unit 14 to which the toner image is transferred as a primary transfer, a toner supply unit 15 that replenishes toner to the image forming section 13, and a fixing unit 16 that fixes a non-fixed toner image, which has been formed on the sheet P, on it. A discharge unit 17 is also provided at the upper portion of the main body 11; after fixing processing has been performed on the sheet P in the fixing unit 16, the sheet P is discharged to the discharge unit 17.

An operation panel (not illustrated), which is used to enter, for example, a condition under which the sheet P is outputted, is provided on the upper surface of the main body 11. The operation panel includes a power key, a touch panel from which to enter output conditions, and various operation keys.

The main body 11 further includes a sheet transport path 111, which vertically extends, to the right of the image forming section 13. A transport roller pair 112, which transports a sheet, is attached at an appropriate position on the sheet transport path 111. A registration roller pair 113 is provided upstream of the nip part on the sheet transport path 111. The registration roller pair 113 corrects sheet skew and feeds a sheet to a secondary transfer nip part, described later, at a prescribed time. The sheet transport path 111 transports the sheet P from the paper feeder 12, through the image forming section 13 and fixing unit 16, to the discharge unit 17.

The paper feeder 12 has a paper feed tray 121, a pickup roller 122, and a paper feed roller 123. The paper feed tray 121 is removably attached at a lower position in the main body 11 to store a sheet stack P1, which is a plurality of stacked sheets P. The pickup roller 122 draws the sheet stack P1 stored in the paper feed tray 121, one sheet P at a time, starting from the uppermost sheet P. The paper feed roller 123 feeds the sheet P drawn by the pickup roller 122 to the sheet transport path 111.

The paper feeder 12 has a manual feeding unit attached to the left side surface, illustrated in FIG. 1, of the main body 11. The manual feeding unit has a manual paper feed tray 124, a pickup roller 125, and a paper feed roller pair 126. The manual paper feed tray 124 is a tray on which a sheet P, to be manually fed, is placed. When a sheet P is manually fed, the manual paper feed tray 124 is opened on a side of the main body 11 as illustrated in FIG. 1. The pickup roller 125 draws the sheet P placed on the manual paper feed tray 124. The paper feed roller pair 126 feeds the sheet P drawn by the pickup roller 125 to the sheet transport path 111.

The image forming section 13 includes a plurality of image forming units that form toner images in different colors to form a toner image to be transferred to the sheet P. In this embodiment, these image forming units are a yellow image forming unit 13Y, a cyan image forming unit 13C, a magenta image forming unit 13M, and a black image forming unit 13BK positioned in this order from the upstream end toward to the downstream end in the rotational direction of an intermediate transfer belt 141, which will be described later (from the left side toward the right side in FIG. 1). These image forming units 13Y, 13C, 13M, and 13BK each have the photosensitive drum 20 as well as a charging unit 21, a developing unit 23, and a cleaning unit 25, which are positioned around the photosensitive drum 20. An exposing unit 22 shared by the image forming units 13Y, 13C, 13M, and 13BK is located underneath these image forming units. Primary transfer rollers 24 (24Y, 24C, 24M, and 24BK) (see FIG. 2) are positioned facing the photosensitive drums 20 of the image forming units 13Y, 13C, 13M, and 13BK.

The photosensitive drum 20 has a rotational axis. The photosensitive drum 20 is rotationally driven in a prescribed rotational direction, as indicated by the arrow D1 in FIG. 2, around the rotational axis so that an electrostatic latent image is formed on the circumferential surface of the photosensitive drum 20 and supports a toner image that matches the electrostatic latent image. An example of the photosensitive drum 20 is a photosensitive drum made of an amorphous silicon (a-Si)-based material. The charging unit 21 uniformly charges the circumferential surface of the photosensitive drum 20. The charging unit 21 has a charging roller and a charge cleaning brush that removes toner adhering to the charging roller. In this embodiment, a direct-current voltage is applied to the charging roller of the charging unit 21 to charge the circumferential surface of the photosensitive drum 20.

The exposing unit 22 has a light source, a polygon mirror, a reflecting mirror, a deflecting mirror, and other optics. The exposing unit 22 directs light, which has been modulated according to image data, to the circumferential surface of the charged photosensitive drum 20 to form an electrostatic latent image.

The developing unit 23 supplies toner to the circumferential surface of the photosensitive drum 20 to develop the electrostatic latent image formed on the photosensitive drum 20. The developing unit 23 includes two agitating rollers 23A, a magnetic roller 23B, and a developing roller 23D. The agitating rollers 23A circularly transport a two-component developer including toner and carriers while agitating the developer, charging the toner. A two-component developer layer is supported on the circumferential surface of the magnetic roller 23B. A toner layer is supported on the circumferential surface of the developing roller 23D, the toner layer being formed when toner is transmitted due to a difference in electric potential between the magnetic roller 23B and the developing roller 23D. The toner on the developing roller 23D is supplied to the circumferential surface of the photosensitive drum 20, developing the electrostatic latent image.

The primary transfer roller 24 (transfer roller), which is positioned facing the photosensitive drum 20 with the intermediate transfer belt 141 interposed therebetween, forms a primary transfer nip part between the primary transfer roller 24 and the photosensitive drum 20. The primary transfer roller 24 transfers the toner image formed on the photosensitive drum 20 to the intermediate transfer belt 141 as a primary transfer.

After the toner image has been transferred to the photosensitive drum 20, the cleaning unit 25 cleans the circumferential surface of the photosensitive drum 20. Referring to the image forming unit 13M in FIG. 2, the cleaning unit 25 has a cleaner housing 251 (housing), a cleaning blade 252, and a transport screw 253. The cleaner housing 251, which is the case of the cleaning unit 25, supports the cleaning blade 252. The cleaning blade 252 abuts the photosensitive drum 20 and cleans the circumferential surface of the photosensitive drum 20. The transport screw 253 transports toner collected by the cleaning blade 252 to a collection bottle (not illustrated).

The intermediate transfer unit 14 is located in a space formed between the image forming section 13 and the toner supply unit 15. The intermediate transfer unit 14 has the intermediate transfer belt 141 (transfer belt), a driving roller 142, which is rotatably supported by a unit frame (not illustrated), and a driven roller 143, and a backup roller 146. The intermediate transfer belt 141, which is an endless belt, is stretched around the driving roller 142, driven roller 143, and backup roller 146. The outer circumferential surface of the intermediate transfer belt 141 abuts the circumferential surfaces of the photosensitive drums 20 of the plurality of image forming units. The driving roller 142 receives a rotational driving force generated by a motor (not illustrated). The intermediate transfer belt 141 is driven by the rotation of the driving roller 142 so as to circulate. Thus, the surface of the intermediate transfer belt 141 moves in a prescribed direction (as indicated by the arrows D2 in FIG. 2) with respect to the plurality of photosensitive drums 20. Toner images are sequentially transferred from the plurality of photosensitive drums 20 to the surface of the intermediate transfer belt 141. A belt cleaning unit 144, which removes toners, is provided in the vicinity of the driven roller 143.

A secondary transfer roller 145 is positioned facing the driving roller 142 with the intermediate transfer belt 141 interposed therebetween. The secondary transfer roller 145 is brought into pressure contact with the circumferential surface of the intermediate transfer belt 141 and forms a secondary transfer nip part between the secondary transfer roller 145 and the driving roller 142. The toner image formed on the intermediate transfer belt 141 as the result of the primary transfer is further transferred, as a secondary transfer, to the sheet P supplied from the paper feeder 12 in the secondary nip part. A roll cleaner 200 is provided to clean the circumferential surface of the driving roller 142.

The toner supply unit 15 holds the toner that is used to form an image. In this embodiment, toner containers 15Y, 15C, 15M, and 15BK are provided that respectively hold toners, in yellow, cyan, magenta and black, to be replenished. Each color of toner is replenished from a toner discharge port 15H formed at the bottom of the relevant container through a toner transporting unit to the developing unit 23 in the relevant of the image forming unit 13Y, 13C, 13M, or 13BK corresponding to yellow, cyan, magenta, or black.

The fixing unit 16 has a heating roller 161 that incorporates a heating source, a fixing roller 162 disposed facing the heating roller 161, a fixing belt 163 stretched around the fixing roller 162 and heating roller 161, and a pressurizing roller 164 disposed facing the fixing roller 162 with the fixing belt 163 interposed therebetween so as to form a fixing nip part. The sheet P supplied to the fixing unit 16 is heated and pressurized while passing through the fixing nip part. Thus, the toner image transferred to the sheet P in the transfer nip part is fixed to the sheet P.

The discharge unit 17 has a concave part formed by recessing the top of the main body 11. A discharge tray 171 that accepts a discharged sheet P is formed at the bottom of the concave part. The sheet P that has undergone fixing processing is discharged through the sheet transport path 111, extending from the top of the fixing unit 16, toward the discharge tray 171.

Further referring to FIG. 1, the image forming apparatus 10 includes an environment sensor 500. The environment sensor 500 senses temperature and humidity around the image forming apparatus 10.

Figure 3A:
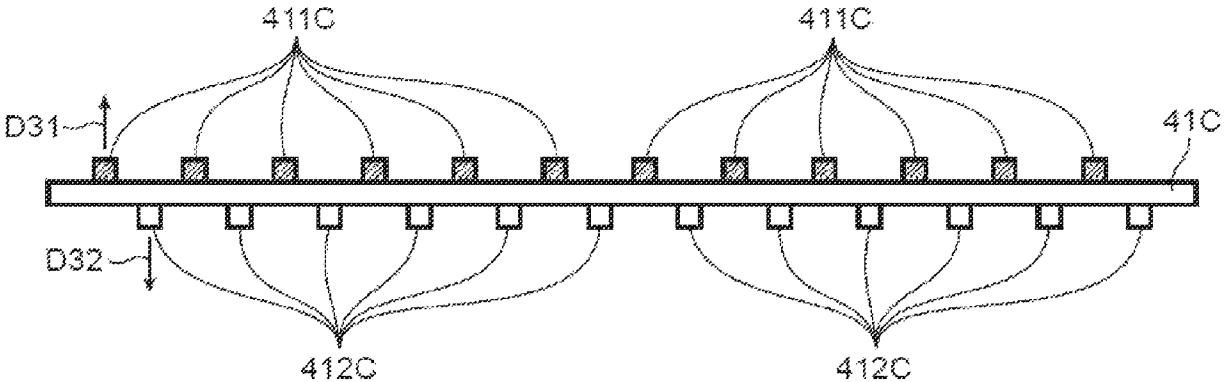
FIG. 3A is a plan view of a static remover in an embodiment of the present disclosure.

Referring to FIG. 2, each of the image forming units 13Y, 13C, 13M, and 13BK has a static remover 40. Referring to the cyan image forming unit 13C in FIG. 2, the static remover 40 has a circuit board 41, post-transfer static removing elements 411 (first light-emitting elements) and pre-transfer static removing elements 412 (second light-emitting elements). The static remover 40 is attached to the cleaner housing 251 of the cleaning unit 25 (see the magenta image forming unit 13M in FIG. 2). FIG. 3A is a plan view that schematically illustrates the structures of the circuit board 41, post-transfer static removing element 411, and pre-transfer static removing element 412.

A plurality of post-transfer static removing elements 411 are located at intervals on the circuit board 41 (see FIG. 3A). Each post-transfer static removing element 411 emits post-transfer charge-removing light toward a portion on the circumferential surface of one photosensitive drum 20 in the plurality of image forming units 13, the portion being downstream of a position opposite to the position of the primary transfer roller 24 in the rotational direction of the photosensitive drum 20. The cyan post-transfer static removing elements 411C in FIG. 2 emits post-transfer charge-removing light toward the circumferential surface of the cyan photosensitive drum 20C (as indicated by the arrow D31 in FIG. 3A). The post-transfer static removing element 411 is a light-emitting element typified by a light-emitting diode (LED).

A plurality of pre-transfer static removing elements 412 are positioned at intervals on the circuit board 41 (see FIG. 3A). The pre-transfer static removing elements 412 are located on a surface, of the circuit board 41, that is opposite to the surface on which the post-transfer static removing elements 411 are located. One pre-transfer static removing element 412 is located between two adjacent post-transfer static removing elements 411 in the axial direction of the rotational axis of the photosensitive drum 20. The pre-transfer static removing element 412 emits pre-transfer charge-removing light toward a portion on the circumferential surface of another photosensitive drum located downstream of the one photosensitive drum in the movement direction of the intermediate transfer belt 141, the portion being upstream of a position opposite to the position of the primary transfer roller 24 corresponding to the other photosensitive drum in the rotational direction of the photosensitive drum 20. The cyan pre-transfer static removing elements 412C in FIG. 2 emits pre-transfer charge-removing light toward the circumferential surface of the magenta photosensitive drum 20M (as indicated by the arrow D32 in FIG. 3A, the arrow D32 in FIG. 3A being oriented in the same direction as the arrows D2 in FIG. 2). The pre-transfer static removing element 412 is a light-emitting element typified by an LED.

Figure 3B:
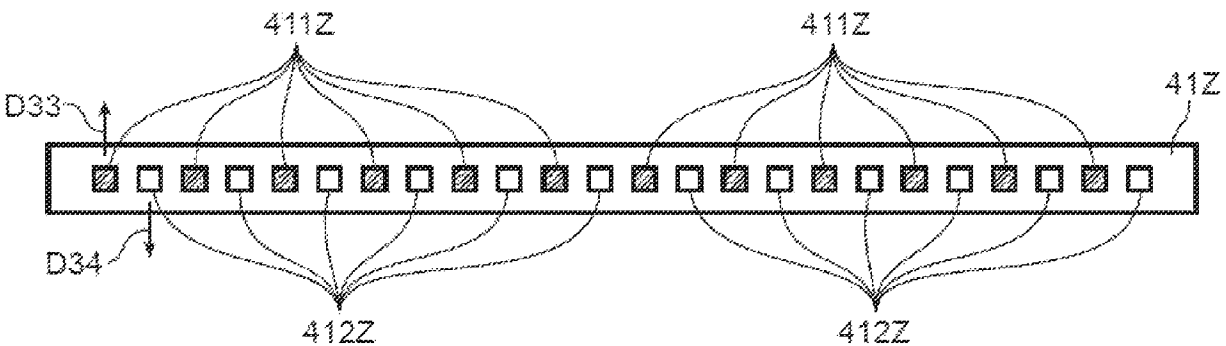
FIG. 3B is a front view of a static remover in another embodiment of the present disclosure.

FIG. 3B schematically illustrates a layout of post-transfer static removing elements 411Z and pre-transfer static removing elements 412Z, which are mounted on a circuit board 41Z in another embodiment. As illustrated in this drawing, the post-transfer static removing elements 411Z and pre-transfer static removing elements 412Z may be alternately placed on the same surface of the circuit board 41Z. In this case, the circuit board 41Z is positioned along the belt surface of the intermediate transfer belt 141; the post-transfer static removing elements 411Z emit post-transfer charge-removing light in the direction indicated by the arrow D33 in FIG. 3B, and the pre-transfer static removing elements 412Z emit post-transfer charge-removing light in the direction indicated by the arrow D34.

Next, the relationship between the positions of the image forming units 13 and the amount of charge-removing light emitted by the static remover 40 will be described.

Referring to the magenta image forming unit 13M in FIG. 2, an electrostatic latent image is formed on the circumferential surface of the photosensitive drum 20M, which has been charged by the charging unit 21M, by laser light L (see FIG. 2) emitted from the exposing unit 22 (see FIG. 1). In this embodiment, the charging unit 21M positively charges the circumferential surface of the photosensitive drum 20M because toner used by the developing unit 23M is positively charged. The electrostatic latent image formed on the circumferential surface of the photosensitive drum 20M is visualized as a toner image by toner supplied from the developing unit 23M. The toner image is transferred to the surface of the intermediate transfer belt 141 in the primary transfer nip part formed between the photosensitive drum 20M and the primary transfer roller 24M, as a primary transfer. To achieve the primary transfer, a voltage with a negative polarity, opposite to the polarity of the charged toner, is applied to the primary transfer roller 24M. In this embodiment, to provide a stable transfer current flow into the primary transfer nip part, a voltage is applied so that the transfer current is made constant by a constant-current controller (not illustrated).

If constant current control is carried out as described above, in the transfer nip part, the difference in electric potential between the non-image part on the photosensitive drum 20M and the primary transfer roller 24M is likely to become greater than the difference in electric potential between the image part on the photosensitive drum 20M and the primary transfer roller 24M. Thus, a large amount of transfer current flows from the primary transfer roller 24M to the non-image part on the photosensitive drum 20M. If the transfer current is increased by the constant-current controller to increase transfer current to be supplied to the image part, the current that flows into the non-image part is further increased. As a result, there has been the problem that a change in charge characteristics occurs between the image part and non-image part on the photosensitive drum 20M and the change in charge characteristic remains as a history, that is, a so-called transfer memory occurs.

Figure 4B:
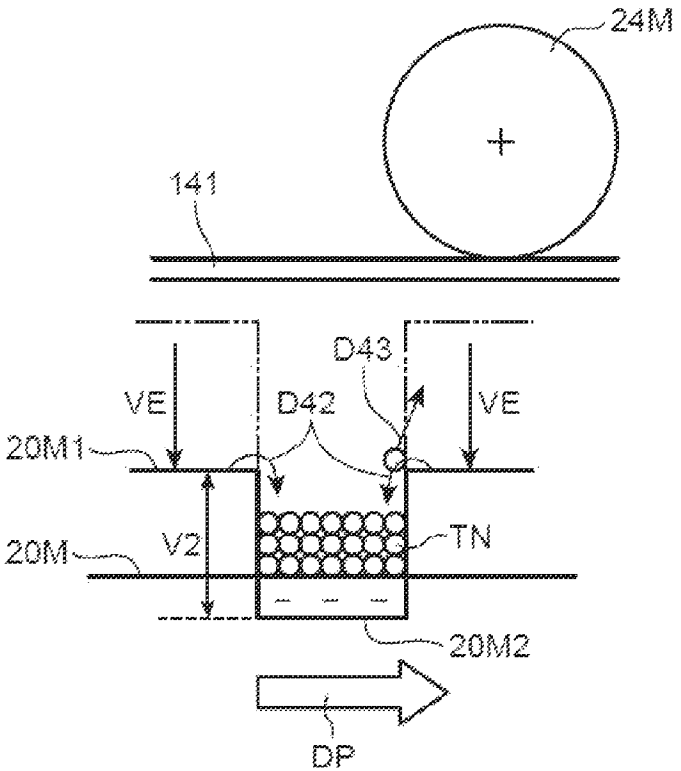
FIG. 4B schematically illustrates an effect of an electric potential on the surface of the photosensitive drum in an embodiment of the present disclosure after pre-transfer charge-removing light has been emitted.
Figure 4A:
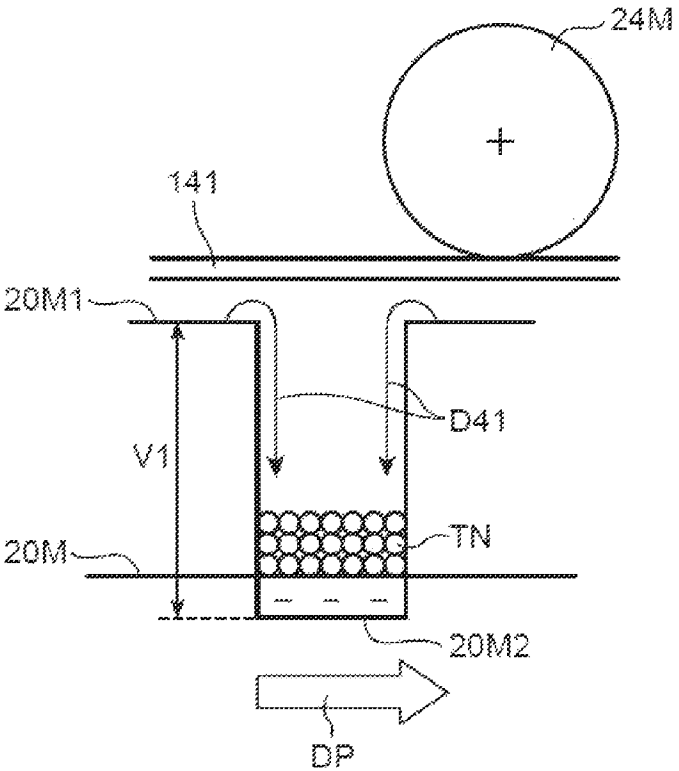
FIG. 4A schematically illustrates an effect of an electric potential on the surface of the photosensitive drum in an embodiment of the present disclosure when pre-transfer charge-removing light is not emitted.

To solve the above problem, in this embodiment, the pre-transfer static removing element 412C in the static remover 40C emits pre-transfer charge-removing light toward the circumferential surface of the photosensitive drum 20M before the primary transfer is performed in the primary transfer nip part. FIGS. 4A and 4B schematically illustrate an effect of charge-removing light on the circumferential surface of the photosensitive drum 20M. FIG. 4A is a schematic diagram when pre-transfer charge-removing light is not emitted, and FIG. 4B is a schematic diagram after pre-transfer charge-removing light has been emitted. The circumferential surface of the photosensitive drum 20M is moved toward the primary transfer roller 24M, which is positioned with the intermediate transfer belt 141 interposed therebetween, in the direction indicated by the arrow DP. A non-image part's electric potential 20M1 and an image-part's electric potential 20M2 are also schematically illustrated as electric potentials on the circumferential surface of the photosensitive drum 20M. Toner TN is supported on the circumferential surface of the photosensitive drum 20M in correspondence to the electric potential on the image-part's electric potential 20M2.

Referring to FIG. 4A, on the circumferential surface of the photosensitive drum 20M when pre-transfer charge-removing light is not emitted, a difference in electric potential between the non-image part's electric potential 20M1 and the image-part's electric potential 20M2 is V1. The electric potential difference V1 is considered to be adequate to hold the toner TN, which is supported to the image part on the photosensitive drum 20M, on the circumferential surface of the photosensitive drum 20M. That is, since the non-image part's electric potential 20M1 is maintained at an electric potential that is greater than the image-part's electric potential 20M2 by the electric potential difference V1, the toner TN is pressed against the circumferential surface of the photosensitive drum 20M as indicated by the arrows D41. If, however, the circumferential surface of the photosensitive drum 20M is moved to the primary transfer nip part of the primary transfer roller 24M while the electric potential difference V1 is maintained on the circumferential surface, a transfer memory as described above is likely to occur.

Referring to FIG. 4B, if pre-transfer charge-removing light is emitted to the circumferential surface of the photosensitive drum 20M by the pre-transfer static removing element 412C, the electric potential on the non-image part is reduced by a charge-removing potential VE. As a result, the difference in electric potential between the non-image part's electric potential 20M1 and the image-part's electric potential 20M2 becomes V2 (V2<V1). Since the difference in electric potential between the image-part's electric potential 20M2 and the non-image part's electric potential 20M1 is less when compared with FIG. 4A, too much transfer current is prevented from flowing into the non-image part in the primary transfer nip part. Thus, when pre-transfer charge-removing is performed, a transfer memory is suppressed which would otherwise be caused if the photosensitive drum 20M has a difference between the amount of transfer current flowing into the image part and the amount of transfer current flowing into the non-image part.

If, however, the difference in the electric potential between the image-part's electric potential 20M2 and the non-image part's electric potential 20M1 is reduced as illustrated in FIG.

4B, the force with which the toner TN is pressed against the circumferential surface of the photosensitive drum 20M is reduced as indicated by the arrows D42. As a result, as the toner TN comes close to the primary transfer roller 24M, toner at an end of the image part may scatter to the non-image part as indicated by the arrows D43. If a discharge occurs in a wedge-like pre-nip part PN (see FIG. 2) formed between the circumferential surface of the photosensitive drum 20M and the circumferential surface of the primary transfer roller 24M, more toner scatters. In a tandem-type image forming apparatus, toner images are transferred sequentially to the intermediate transfer belt 141 and are overlapped. In a primary transfer nip part on a downstream side in the image forming order (on a downstream side in the rotational direction of the intermediate transfer belt 141 as indicated by the arrows D2 in FIG. 2, this downstream side being simply referred to below as the downstream side), a discharge is likely to occur due to toner that has already been transferred to the intermediate transfer belt 141, so the above scatter of toner is likely to become noticeable.

Figure 5:
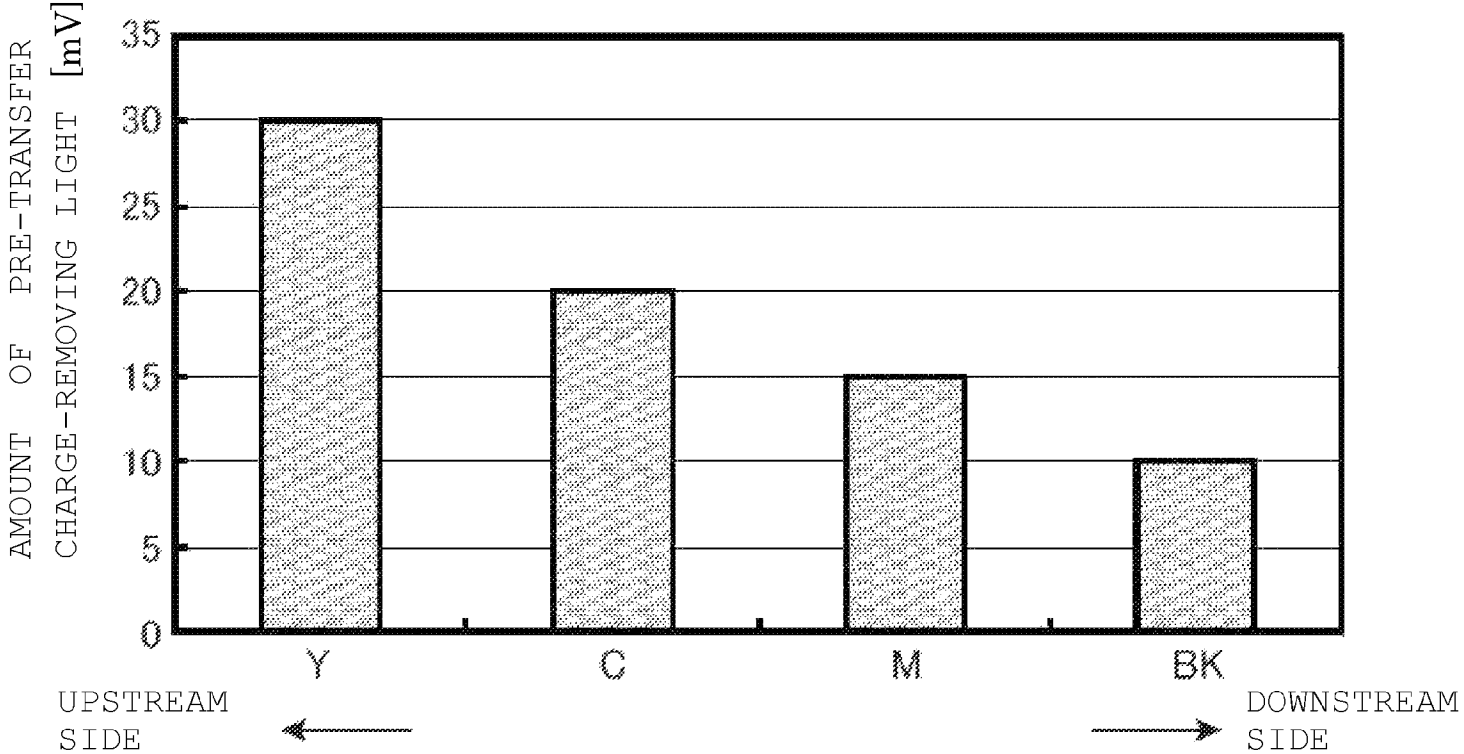
FIG. 5 is a graph illustrating the amount of pre-transfer charge-removing light in an embodiment of the present disclosure.
Figure 6:
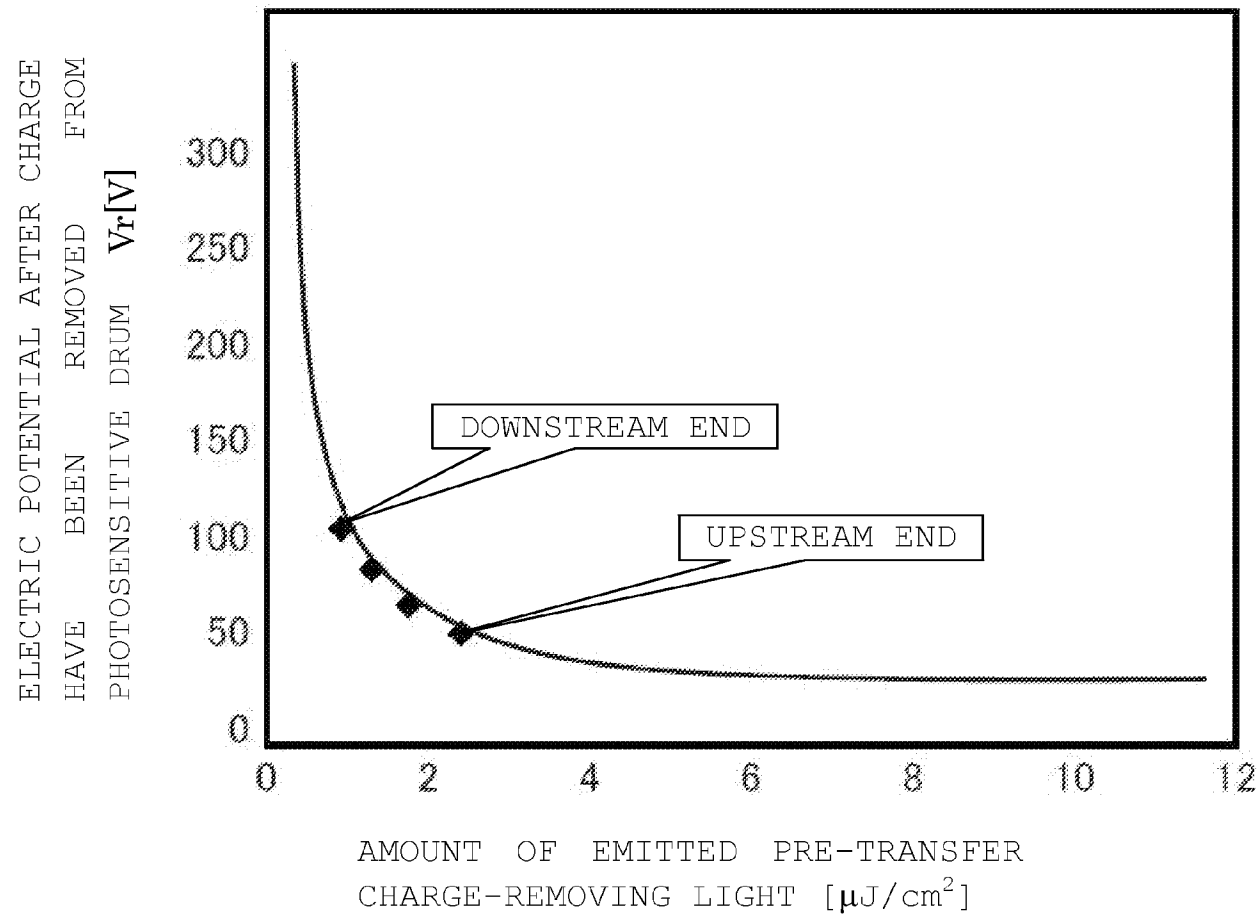
FIG. 6 is a graph illustrating electric potentials after charges have been removed from photosensitive drums in an embodiment of the present disclosure.

In this embodiment, the amount by which pre-transfer charge-removing light is emitted by the static remover 40 is preferably set according to the positions of the image forming units 13. FIG. 5 is a graph illustrating a relationship, in this embodiment, between the positions of the image forming units 13 and the amount of emitted pre-transfer charge-removing light. FIG. 6 is a graph illustrating a relationship between the amount of emitted pre-transfer charge-removing light and the non-image part's electric potential on the photosensitive drum 20 after charges are removed.

In this embodiment, as illustrated in FIG. 5, the amount of pre-transfer charge-removing light that one pre-transfer static removing element 412 of one static remover 40 included in a plurality of image forming units 13 emits toward the circumferential surface of the relevant photosensitive drum 20 is set to a value that is less than the amount of pre-transfer charge-removing light that another pre-transfer static removing element 412 emits to the circumferential surface of the relevant photosensitive drum 20, the other pre-transfer static removing element 412 being located upstream of the one pre-transfer static removing element 412 in the movement direction of the intermediate transfer belt 141. In other words, the amount of pre-transfer charge-removing light emitted by a pre-transfer static removing element 412 located on the downstream side in the movement direction of the intermediate transfer belt 141 (image forming order) is set to a value less than the amount of pre-transfer charge-removing light emitted by another pre-transfer static removing element 412 located on the upstream side.

Referring to FIG. 6, in this embodiment, the amount of pre-transfer charge-removing light emitted to a photosensitive drum 20Y disposed on the upstream end in the image forming order is 2.3 $\mu J/cm^2$. Accordingly, the electric potential on the surface of the non-image part on the photosensitive drum 20Y is reduced to about 50 V. The amount of pre-transfer charge-removing light emitted to a photosensitive drum 20BK located on the downstream end is 0.9 $\mu J/cm^2$. Accordingly, the electric potential on the surface of the non-image part on the photosensitive drum 20Bk is set to about 105 V. This preferably suppresses the scatter of toner, which would otherwise easily occur on the photosensitive drums 20 on the downstream side in the image forming order. On the photosensitive drums 20 on the upstream side of the image forming order, the difference in electric potential between the image part and the non-image part is preferably reduced and the occurrence of a transfer memory is suppressed.

Figure 7:
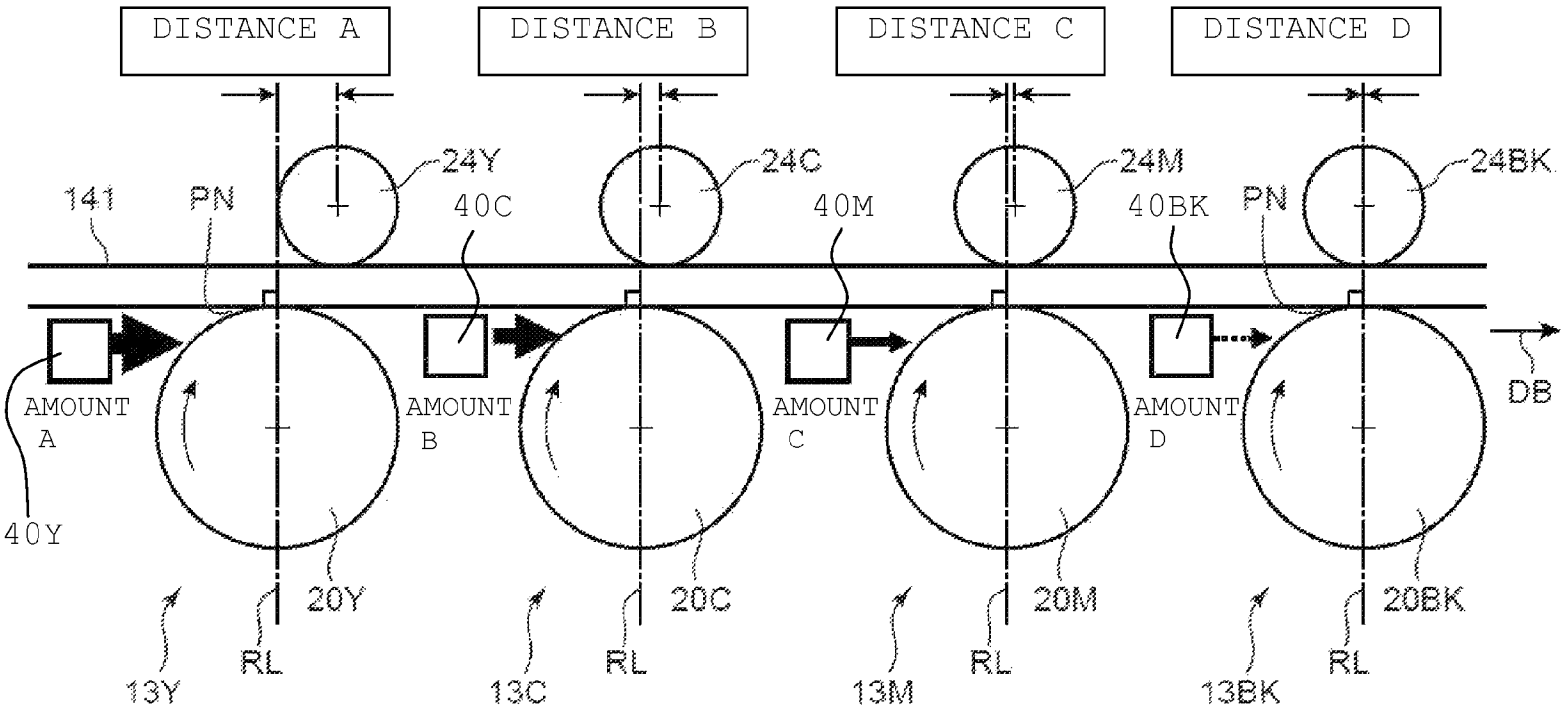
FIG. 7 illustrates a layout of transfer rollers in an embodiment of the present disclosure.

Furthermore, in this embodiment, scatter of the toner is preferably suppressed on the photosensitive drums 20 on the upstream side of the above image forming order. FIG. 7 schematically illustrates the positional relationship between the photosensitive drum 20 of the image forming units 13 in different colors and their corresponding primary transfer rollers 24. In FIG. 7, the intermediate transfer belt 141 moves from the left on the drawing toward the right as indicated by the arrow DB.

In a cross section of the photosensitive drum 20Y on which its rotational axis intersects, the roller axis of the primary transfer roller 24Y is located downstream of a straight line RL in the movement direction of the intermediate transfer belt 141, as indicated by the arrow DB. The straight line RL passes through the rotational axis of the photosensitive drum 20Y that the primary transfer roller 24Y faces, and is orthogonal to the belt surface of the intermediate transfer belt 141. In the image forming units 13 downstream of the image forming unit 13Y as well, the roller axis of the primary transfer roller 24 is similarly located downstream of the straight line RL. In the image forming unit 13BK located at the downstream end, the roller axis of the primary transfer roller 24BK may be located on the straight line RL.

In this embodiment, the distance between the straight line RL and the roller axis of one of the plurality of primary transfer rollers 24 is set to a value greater than the distance between the straight line RL and the roller axis of another primary transfer roller 24 located downstream of the one primary transfer roller 24 in the movement direction of the intermediate transfer belt 141. In other words, the distance between the straight line RL and the roller axis of a primary transfer roller 24 located on the upstream side in the movement direction of the intermediate transfer belt 141 (image forming order) is set to a value greater than the distance between the straight line RL and the roller axis of a primary transfer roller 24 located on the downstream side. In FIG. 7, distance A, distance B, distance C, and distance D are greater in this order. In this embodiment, the distances A, B, C, and D are different in the range of 1 mm to 1.5 mm. In FIG. 7, the amounts A, B, C, and D of emitted pre-transfer charge-removing light are larger in this order.

With the primary transfer rollers 24 and photosensitive drums 20 located on the upstream side of the image forming order, if the positional relationship between the straight line RL and the roller axis of the primary transfer roller 24 is satisfied as described above, the primary transfer roller 24 is separated more from the pre-nip part PN. Therefore, a discharge is less likely to occur in the pre-nip part PN. Even if much more pre-transfer charge-removing light is emitted to suppress a transfer memory when compared with the photosensitive drums 20 on the downstream side, scatter of the toner is preferably suppressed.

In another embodiment, the primary transfer roller 24 may be positioned so that its circumferential surface follows the circumferential surface of the photosensitive drum 20. In other words, the primary transfer roller 24 may be positioned so that the distance between the roller axis of the primary transfer roller 24 and the rotational axis of the photosensitive drum 20 is maintained at a certain value. When the primary transfer roller 24 is positioned in this way, the intermediate transfer belt 141 is pressed toward (laps) the circumferential surface of the photosensitive drum 20 by the primary transfer roller 24, with a prescribed width. Therefore, the space in the pre-nip part PN is likely to be reduced and a discharge in the pre-nip part PN is likely to be further reduced.

Figure 8:
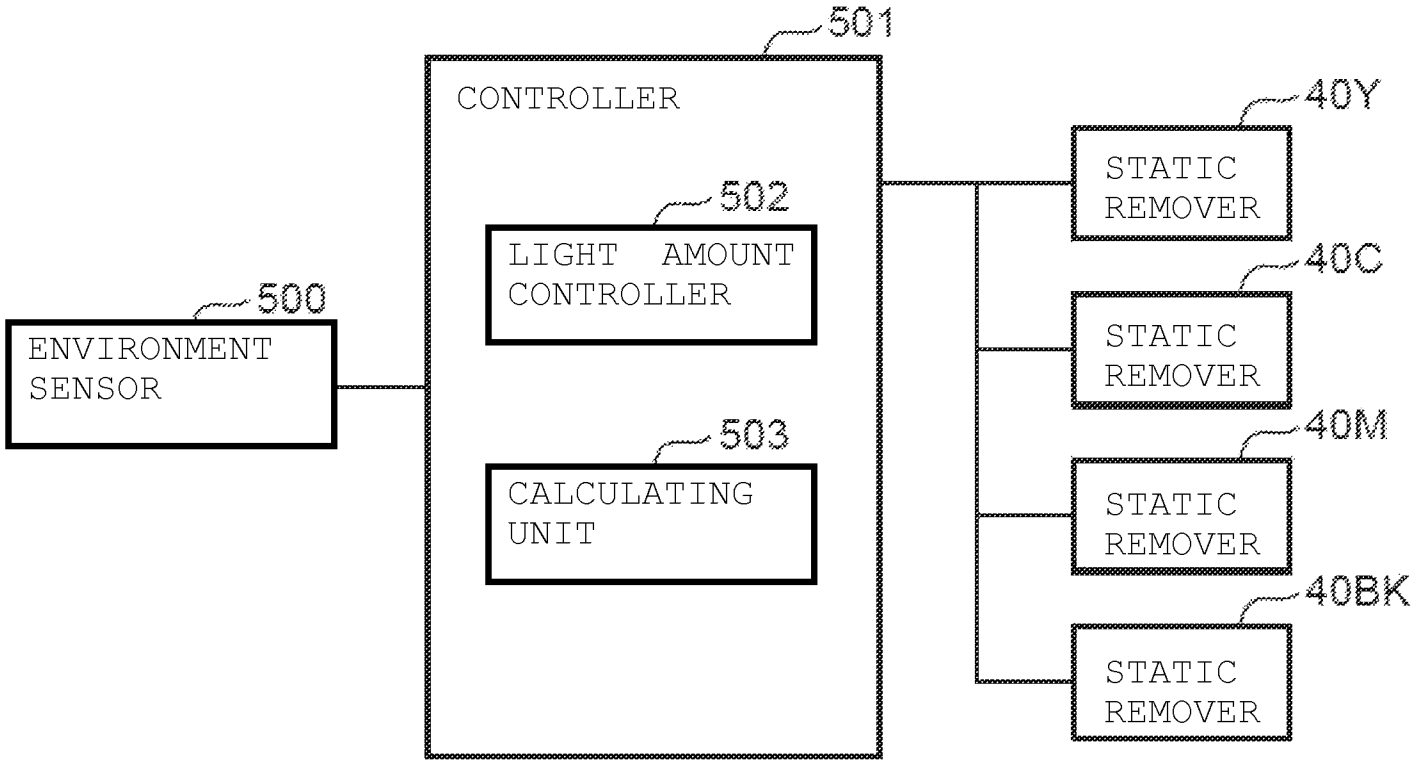
FIG. 8 is an electrical block diagram of a controller in an embodiment of the present disclosure.
Figure 9:
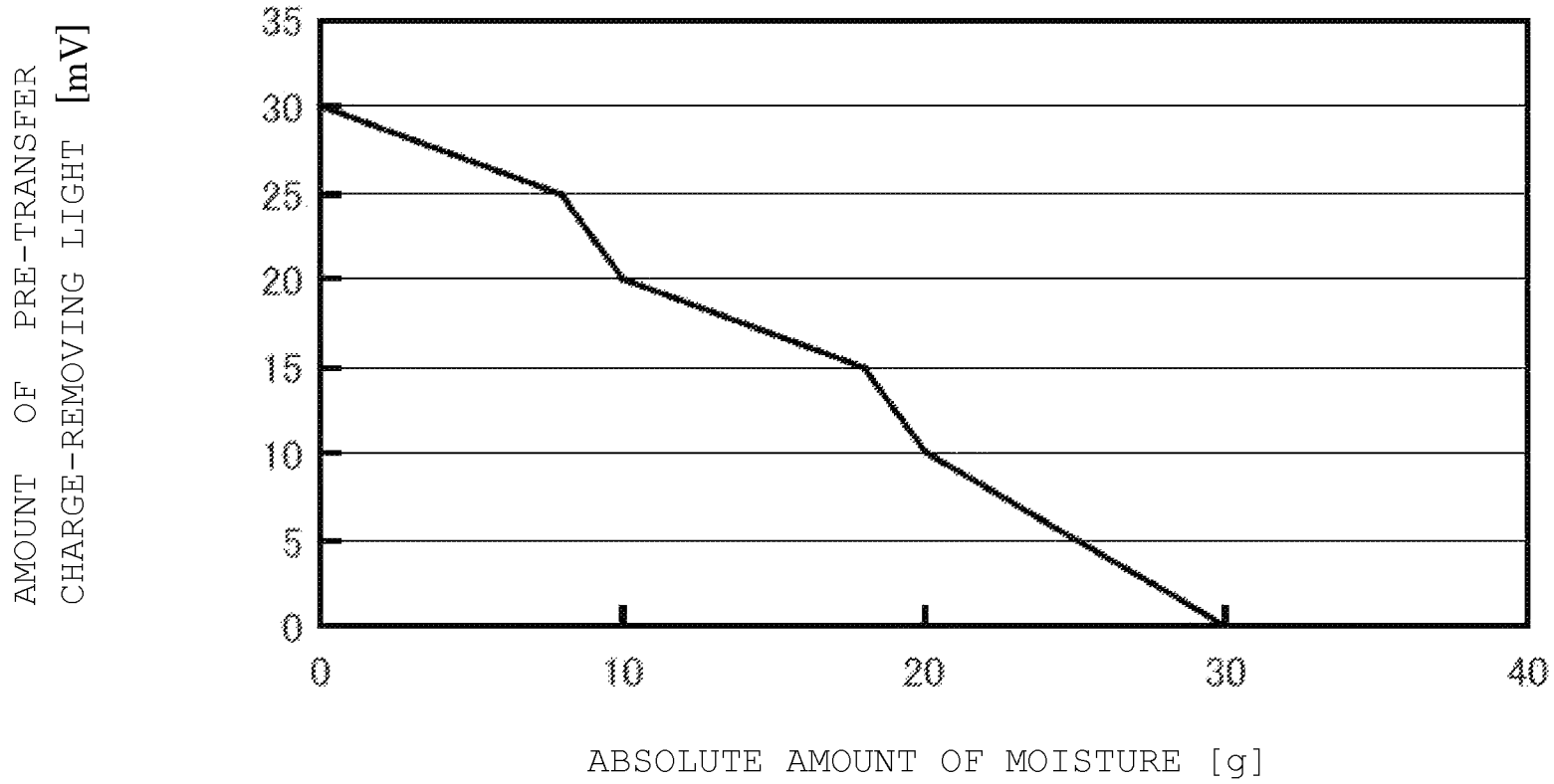
FIG. 9 is a graph indicating a relationship between the amount of pre-transfer charge-removing light and the amount of moisture in the air in an embodiment of the present disclosure.

Furthermore, in this embodiment, the amount of charge-removing light emitted by the static remover 40 is preferably controlled according to the environment around the image forming apparatus 10. FIG. 8 is an electrical block diagram of a controller 501 in the image forming apparatus 10. FIG. 9 is a graph indicating the relationship between the absolute amount of moisture in the air and the amount of pre-transfer charge-removing light.

The controller 501, illustrated in FIG. 8, in the image forming apparatus 10 comprehensively controls the operations of components included in the image forming apparatus 10. The controller 501 includes a central processing unit (CPU), a read-only memory (ROM) that stores a control program, a random-access memory (RAM) used as a working area of the CPU. The environment sensor 500 and the static removers 40 included in the image forming units 13 in the four colors (that is, yellow static remover 40Y, cyan static remover 40C, magenta static remover 40M, and black static remover 40BK), described above, are electrically connected to the controller 501.

When the CPU executes the control program stored in the ROM, the controller 501 functions so that a light amount controller 502 and a calculating unit 503 are implemented.

The light amount controller 502 determines the amount of light emitted by the static remover 40 in each color, which includes the post-transfer static removing element 411 and pre-transfer static removing element 412 and causes the static remover 40 to emit the determined amount of light. In this embodiment, when determining the amount of light that is emitted by the static remover 40, the light amount controller 502 also considers the amount of moisture in the air, which is calculated by the calculating unit 503. For this determination, a look-up table (LUT), which indicates the relationship between the absolute amount of moisture in the air and the optimum amount of light to be emitted by the static remover 40 is prestored in the light amount controller 502.

The calculating unit 503 calculates the amount of moisture in the air according to temperature and humidity data sensed by the environment sensor 500. The amount of moisture in the air is calculated by multiplying the amount of saturated water vapor by relative humidity. The amount of saturated water vapor is derived according to measured temperature and humidity data.

In a high-temperature, high-humidity environment, the capability of the toner to remain charged is lowered, so the force with which toner adheres to the circumferential surface of the photosensitive drum 20 is reduced. Thus, toner becomes likely to scatter in the pre-nip part PN (see FIG. 7). In this high-temperature, high-humidity environment, however, the charging unit 21 maintains high charging performance, so the charging unit 21 easily removes the difference in electric potential between the image part and non-image part on the photosensitive drum 20; the difference would otherwise cause a transfer memory. Particularly, if a DC chagrining roller to which a direct-current voltage is applied is used as the charging unit 21 as in this embodiment, the charging unit 21 maintains high charging performance in a high-temperature, high-humidity environment.

In a low-temperature, low-humidity environment, the capability of toner to remain charged is increased, so the force with which toner adheres to the circumferential surface of the photosensitive drum 20 is increased. Thus, toner becomes less likely to scatter in the pre-nip part PN (see FIG. 7). In this high-temperature, high-humidity environment, however, the charging performance of the charging unit 21 is relatively lowered, so it becomes comparatively difficult for the charging unit 21 to remove the difference in electric potential between the image part and non-image part on the photosensitive drum 20; the difference would otherwise cause a transfer memory. Particularly, when a DC chagrining roller to which a direct-current voltage is applied is used as the charging unit 21 as in this embodiment, the charging performance of the charging unit 21 tends to be lowered in a low-temperature, low-humidity environment.

Even in the above environment, in this embodiment, the light amount controller 502 can control the amount by which the static remover 40 emits light according to the surrounding temperature and humidity environment. That is because the table indicating the relationship as illustrated in FIG. 9 is prestored in the light amount controller 502. When the absolute amount of moisture per unit volume in the air is within the range of 0 gram to 30 grams, the amount of pre-transfer charge-removing light emitted by the pre-transfer static removing element 412 is set to within the range of 0 mV to 30 mV.

The calculating unit 503 calculates the absolute amount of moisture from the temperature and humidity data sensed by the environment sensor 500. If the absolute amount of moisture is great, the light amount controller 502 decides that temperature and humidity in the surrounding environment are high and sets the amount of light to be emitted by the static remover 40 (specifically, pre-transfer static removing element 412) to a small value. Therefore, even if toner is likely to scatter in a high-temperature, high-humidity environment, the electric potential on the non-image part on the photosensitive drum 20 is not set to an excessively low value. This preferably suppresses toner on the image part from scattering to the surrounding non-image part. Even if the amount of charge-removing light to be emitted is reduced and a comparatively large difference in electric potential remains between the image part and the non-image part, the occurrence of a transfer memory is suppressed by the charging performance of the charging unit 21 (DC charging roller) achieved in a high-temperature, high-humidity environment.

If the absolute amount of moisture calculated by the calculating unit 503 is small, the light amount controller 502 decides that temperature and humidity in the surrounding environment are low and thereby sets the amount of light to be emitted by the static remover 40 (specifically, pre-transfer static removing element 412) to a large value. Thus, the charging performance of the charging unit 21 (DC charging roller) is reduced, and even in an environment in which a transfer memory is likely to occur, the electric potential on the non-image part on the photosensitive drum 20 is reduced to a relatively low value. As a result, the difference in electric potential between the image part and non-image part on the photosensitive drum 20 is reduced, preferably suppressing the occurrence of a transfer memory. Although there is a risk that toner scatters from the image part to the non-image part due to a reduced electric potential on the non-image part on the photosensitive drum 20, the capability of toner to remain charged is high under a low-temperature, low-humidity condition as described above, so the force with which the toner adheres to the circumferential surface of the photosensitive drum 20 remains relatively high. Even if the amount of pre-transfer charge-removing light to be emitted is set to a large value, therefore, toner is less likely to scatter.

When the light amount controller 502 controls the amount of light to be emitted by the static remover 40, it is preferable to satisfy a relationship in advance that indicates the amount of light to be emitted by the static remover 40 (specifically, pre-transfer static removing element 412), the amount being increased or decreased depending on the positions of the image forming units 13. Specifically, the light amount controller 502 preferably prestores a table, as illustrated in FIG.

5, that includes the relationship between the positions of the image forming units 13 and the amount of light to be emitted by the static remover 40.

In an embodiment that has been described so far, in each of a plurality of image forming units 13, the static remover 40 emits pre-transfer charge-removing light toward a portion on the circumferential surface of the photosensitive drum 20, the portion that is upstream of the position opposite to the position of the primary transfer roller 24 in the rotational direction of the photosensitive drum 20. This reduces the difference in electric potential between the image part and non-image part on the photosensitive drum 20. As a result, a partial difference in transfer current that flows from the primary transfer roller 24 into the photosensitive drum 20 is reduced, and the occurrence of a transfer memory is thereby suppressed. In a plurality of image forming units 13 located in succession in a direction in which the intermediate transfer belt 141 moves, toner is transferred from a photosensitive drum 20 located on a downstream side in the movement direction toward the intermediate transfer belt 141 so that the toner overlaps toner that has been already transferred to the intermediate transfer belt 141, so the toner is likely to scatter. In the structure described above, the amount of pre-transfer charge-removing light to be emitted by the pre-transfer static removing element 412 in a static remover 40 located on the downstream side in the movement direction is set to a value less than the amount of pre-transfer charge-removing light to be emitted by the pre-transfer static removing element 412 in a static remover 40 located on the upstream side of the movement direction. That is, with a photosensitive drum 20 located on the downstream side in the movement direction, an amount by which the electric potential on the surface of the photosensitive drum 20 is reduced by the static remover 40 is set to a low value. As a result, on the photosensitive drum 20 located on the downstream side in the movement direction, toner supported on the image part is preferably suppressed from scattering to the non-image part.

In the embodiment described above, toner may likely scatter in a photosensitive drum 20 located on the upstream side in the movement direction. However, the roller axis of the primary transfer roller 24 is shifted so as to be located downstream of the rotational axis of the photosensitive drum 20 in the movement direction. Particularly, the amount of shift of a primary transfer roller 24 located on the upstream side in the movement direction is set to a value greater than the amount of shift of a primary transfer roller 24 located on the downstream side in the movement direction. Therefore, a discharge that would otherwise be caused in a space (pre-nip part PN) on the upstream side in the transfer nip part formed between the photosensitive drum 20 and the primary transfer roller 24 is suppressed particularly at primary transfer rollers 24 located on the upstream side in the movement direction. Accordingly, the scatter of toner is suppressed even further.

In the embodiment described above, even in case in which the ease with which toner scatters and the charging performance of the charging unit 21 changes as the surrounding temperature and humidity environment changes, the light amount controller 502 can still control the amount of light to be emitted by the static remover 40. Accordingly, it is possible to suppress the scatter of toner and the occurrence of a transfer memory in a stable manner.

In the embodiment described above, in a high-temperature, high-humidity environment, the capability of toner to remain charged is low and toner is thereby likely to scatter, but in a low-temperature, low humidity environment, the charging unit 21 easily maintains high charging performance and the charging unit 21 can remove a partial difference in electric potential on the photosensitive drum 20, which would otherwise cause a transfer memory. In the above structure, the light amount controller 502 sets the amount of light to be emitted by the static remover 40 to a small value in a high-temperature, high-humidity environment. Therefore, it becomes possible to preferably suppress the scatter of toner, which is likely to occur in a high-temperature, high-humidity environment, by suppressing the electric potential on the photosensitive drum 20 from dropping.

In the embodiment described above, the static remover 40 includes the circuit board 41, post-transfer static removing element 411, and pre-transfer static removing element 412. Particularly, the post-transfer static removing element 411 emits post-transfer charge-removing light toward one photosensitive drum 20. The pre-transfer static removing element 412 emits pre-transfer charge-removing light to another photosensitive drum next to the one photosensitive drum 20. Accordingly, a single static remover 40 can emit charge-removing light toward two adjacent photosensitive drums 20.

In the embodiment described above, the static remover 40 is attached to the cleaner housing 251 of the cleaning unit 25. Therefore, the cleaner housing 251, which supports the cleaning blade 252 placed in contact with the circumferential surface of the photosensitive drum 20, can be used to support the static remover 40. As a result, a stable emitting path extending from the static remover 40 to the photosensitive drum 20 can be obtained.

The present disclosure suppresses a transfer memory that would otherwise occur between an image part and non-image part on a photosensitive drum and also provides an image forming apparatus that suppresses toner from scattering during a transfer process.

Although the image forming apparatus in embodiments of the present disclosure has been described so far, the present disclosure is not limited to the image forming apparatus; for example, a variation described below can be used.

Although, in the embodiments described above, an aspect has been described in which the light amount controller 502 controls the amount of light to be emitted by the static remover 40 according to detection results of both temperature and humidity sensed by the environment sensor 500, the present disclosure is not limited to this aspect. The light amount controller 502 may control the amount of light to be emitted according to any one of the temperature and humidity sensed by the environment sensor 500. In this case, under a high-temperature or high-humidity condition, the capability of toner to remain charged is likely to be reduced and toner is likely to scatter. However, the charging unit 21 maintains high charging performance. Under a low-temperature or low-humidity condition, the capability of toner to remain charged is maintained at a high level and toner is less likely to scatter. However, the charging performance of the charging unit 21 maintain is likely to be relatively lowered.

Although, in the embodiments described above, an aspect has been described in which the amount of light to be emitted by the static remover 40 (specifically, pre-transfer static removing element 412) or the position of the primary transfer rollers 24 are gradually changed according to the order in which images are formed by the image forming units 13, that is, from the image forming unit 13 at the upstream end (yellow image forming unit 13Y) to the image forming unit 13 at the downstream end (black image forming unit 13BK), the present disclosure is not limited to this aspect. That is, if image forming units 13 are located on the upstream side and downstream side in the movement direction of the intermediate transfer belt 141, the amount of light to be emitted by each static remover 40 or the position of each primary transfer roller 24 may be set as described above. Specifically, the static remover 40 located at the upstream end in the movement direction of the intermediate transfer belt 141 and the static remover 40 located at the second position from the upstream end satisfy the above relationship of the amount of light to be emitted, and the static removers 40 at the third position and later from the upstream end may emit the same amount of light as the static remover 40 at the second position. This is also true for the positions of the primary transfer rollers 24.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

a plurality of image forming units, each of which has a photosensitive drum that has a rotational axis and is rotated in a prescribed rotational direction, the photosensitive drum supporting a toner image on a circumferential surface of the photosensitive drum, a charging unit that charges the circumferential surface, a developing unit that supplies toner to the circumferential surface, and a static remover that emits charge-removing light on a portion on the circumferential surface, the portion being downstream of the developing unit in the rotational direction;

a transfer belt that is brought into contact with a plurality of photosensitive drums of the plurality of image forming units and is rotationally driven so that the surface of the transfer belt moves in a prescribed movement direction and toner images are sequentially transferred to the surface, the transfer belt being an endless belt; and a plurality of transfer rollers, each of which has a roller axis, are located so as to face the plurality of photosensitive drums with the transfer belt interposed between the plurality of transfer rollers and the plurality of photosensitive drums, and transfer the toner images to the transfer belt;

the static remover emits pre-transfer charge-removing light to a circumferential surface portion upstream of a position opposite to a position of the transfer roller in the rotational direction, and an amount of pre-transfer charge-removing light emitted to the circumferential surface by one static remover included in the plurality of image forming units is less than an amount of pre-transfer charge-removing light emitted to another circumferential surface by another static remover located upstream of the one static remover in the movement direction.

2. The image forming apparatus according to claim 1, wherein:

in a cross section on which the rotational axis intersects, the roller axis of the transfer roller is located downstream of a straight line in the movement direction, the straight line passing through the rotational axis of the photosensitive drum that the transfer roller faces, and being orthogonal to a belt surface of the transfer belt; and a distance between the straight line and the roller axis of one transfer roller of the plurality of transfer rollers is greater than a distance between the straight line and the roller axis of another transfer roller located downstream of the one transfer roller in the movement direction.

3. The image forming apparatus according to claim 1, comprising:

an environmental sensor that senses surrounding temperature and humidity; and a light amount controller that controls the amount of pre-transfer charge-removing light emitted by the static remover according to a sensing result obtained by the environmental sensor.

4. The image forming apparatus according to claim 3, wherein the light amount controller controls the amount of pre-transfer charge-removing light emitted by the static remover so that as humidity sensed by the environmental sensor increases, the amount of pre-transfer charge-removing light is reduced.

5. The image forming apparatus according to claim 3, wherein the light amount controller controls the amount of pre-transfer charge-removing light emitted by the static remover so that as temperature sensed by the environmental sensor increases, the amount of pre-transfer charge-removing light is reduced.

6. The image forming apparatus according to claim 1, wherein the charging unit is a charging roller to which a direct-current voltage is applied to charge the circumferential surface of the photosensitive drum.

7. The image forming apparatus according to claim 1, wherein the static remover has a circuit board, a first light-emitting element, mounted on the board, that emits post-transfer charge-removing light toward a portion on the circumferential surface of one photosensitive drum in the plurality of image forming units, the portion being downstream of a position opposite to the position of the transfer roller in the rotational direction, and a second light-emitting element, mounted on the board, that emits pre-transfer charge-removing light toward a portion on a circumferential surface of another photosensitive drum located downstream of the one photosensitive drum in the movement direction, the portion being upstream of a position opposite to a position of a transfer roller corresponding to the another photosensitive drum in the rotational direction.

8. The image forming apparatus according to claim 7, wherein:

the image forming unit has a cleaning unit that cleans the circumferential surface of the photosensitive drum, the cleaning unit including a cleaning blade abutting a portion on the circumferential surface, the portion being downstream of a position, on the photosensitive drum, opposite to the position of the transfer roller in the rotational direction, the cleaning unit also including a housing that supports the cleaning blade; and the static remover is incorporated in the housing of the cleaning unit.

* * * * *